US005154507A

United States Patent [19]

Collins

[11] Patent Number: 5,154,507

[45] Date of Patent: Oct. 13, 1992

[54] LIGHT WITH HOUSING FOR LINEAR LAMP BULB

[76] Inventor: William J. Collins, 4027 Pleasant Ridge Rd., Boulder, Colo. 80301

[21] Appl. No.: 642,815

[22] Filed: Jan. 18, 1991

[51] Int. Cl.[5] ..... F21V 18/00

[52] U.S. Cl. ..... 362/218; 362/220; 362/250; 362/285; 362/294; 362/373

[58] Field of Search ..... 362/226, 294, 217, 285, 362/218, 219, 220, 250, 373

[56] References Cited

U.S. PATENT DOCUMENTS

| | | | |
|---|---|---|---|
| 3,265,885 | 8/1966 | Porter | 362/218 |
| 4,598,347 | 7/1986 | Peppers | 362/294 |
| 4,845,601 | 7/1989 | Podbury et al. | 362/226 |
| 4,887,154 | 12/1989 | Wawro et al. | 362/294 |
| 4,979,081 | 12/1990 | Leach et al. | 362/226 |
| 4,985,815 | 1/1991 | Endo | 362/294 |

*Primary Examiner*—Ira S. Lazarus
*Assistant Examiner*—Sue Hagarman
*Attorney, Agent, or Firm*—Gregg I. Anderson

[57] ABSTRACT

A light for mounting a high intensity linear lamp bulb includes a bulb mount assembly adaptable to various lengths of linear lamp bulb. The light includes a front and rear cover, onto which rear cover slidably mounts the bulb mount assembly. The bulb mount assembly is slidable along longitudinally extending grooves formed in said rear cover to a preselected position set by positioning means. The positioning means also slide along said grooves. The bulb mount assembly is spring biased to allow insertion of the lamp bulb.

21 Claims, 5 Drawing Sheets

LIGHT WITH HOUSING FOR LINEAR LAMP BULB

BACKGROUND OF THE INVENTION

1. Field Of The Invention

The present invention relates generally to lights incorporating a high intensity linear lamp bulb as a light source. The linear lamp bulbs can be quartz halogen, metal halide, high or low pressure sodium and xenon.

2. Description Of The Prior Art

Linear lamp bulbs are highly desirable for high intensity lighting situations. Their use generates significant amounts of heat. Prior art lights do not adequately dissipate heat generated by the linear lamp bulbs, resulting in early bulb failure.

Dissipation of heat at the electrical contact points for the linear lamp bulbs is particularly critical. The glass to metal seal area of such linear lamp bulbs, at their connection to a bulb mount assembly, are particularly sensitive to heat. The linear lamp bulbs can be quartz halogen, metal halide, high or low pressure sodium, and xenon.

Other nonlinear halogen type lamp bulbs also generate significant amounts of heat. Cooling such lights by a fan in combination with a heat sink is shown in U.S. Pat. No. 4,586,117, issued to William J. Collins, inventor herein. Multiple heat sinks and separate fans to cool both an anode and a cathode of a high intensity arc lamp are shown in U.S. Pat. No. 4,935,853, also issued to William J. Collins.

Heretofore, no light incorporating a linear lamp bulb has been adjustable to different lengths corresponding to different wattages of linear lamp bulbs. The bulb mounting system for such linear lamp bulbs is complicated by the fact that lamp holders used to mount the linear lamp bulb must be placed a predetermined distance apart corresponding to the length of the bulb. The ability to selectively move the lamp holders has not been previously known.

It is also often desirable to use such high intensity lights in severe environments where moisture is often encountered. A simple housing for sealing the components of a light in an efficient manner is lacking from the prior art.

SUMMARY OF THE INVENTION

A light for mounting a linear quartz halogen lamp bulb includes a housing comprised of two longitudinally extending front and rear covers and a bulb mount assembly. The linear lamp bulb is mounted in the rear cover. Lamp holders of the bulb mount assembly are slidably mounted in the rear cover and connect to each end of the lamp bulb. End plates enclose and help seal the interior of the housing defined by the connection between the front and rear covers.

A power source is conductively connected, through the front cover, to a pair of terminals slidably mounted within the front cover. The rear cover has a corresponding pair of terminals conductively connected to the linear lamp bulb and slidable within the rear cover. Connection of the rear cover to the front cover places the two pairs of terminals into electrical contact, selectively energizing the lamp bulb.

The lamp holders pass through openings in an integral parabolic reflector surface formed in the front cover. Conductors from the lamp holder carry electricity from the now electrically connected terminal pairs to a bulb contact spring mounted within the lamp holders. The bulb contacts are positioned on a longitudinal axis of the front cover, coaxial with a longitudinal axis of the linear lamp bulb as mounted in the light. The lamp bulb is mounted into the light between the bulb contacts, which are spring loaded relative to the lamp holders.

A terminal housing for each of the terminal pairs is slidable along grooves formed in both the front and rear cover. The grooves are complimentary geometrically, each being the mirror image of the other about a plane at which the two pairs of terminals make contact. Screws and nuts are slidable along these grooves to position the terminal housings relative to the front and rear covers. In a like manner, the lamp holders are slidable in the same grooves and similarly positioned by screws and nuts, defining positioning means for the lamp holders and the connected linear lamp bulbs.

The significant amounts of heat generated by the linear quartz halogen lamp bulbs is dissipated through numerous heat sinks incorporated into the light. The bulb contact includes both an integral heat sink and a second heat sink that is placed over the lamp holder. These heat sinks, in combination, help dissipate heat away from the bulb contact at the connection between the bulb contact and a copper contact of the lamp bulb. The copper contact of the lamp bulb is conductively connected to a molybdenum filament of the linear lamp bulb, where significant amounts of heat are generated. Both the front and rear covers act as heat sinks as well, incorporating integral fins into their structure to help radiate away excess heat.

Other aspects, features and details of the present invention can be more completely understood by reference to the following detailed description of the preferred embodiments, taken in conjunction with the drawings, and from the appended claims.

DESCRIPTION OF THE PREFERRED EMBODIMENTS

Figure 1:
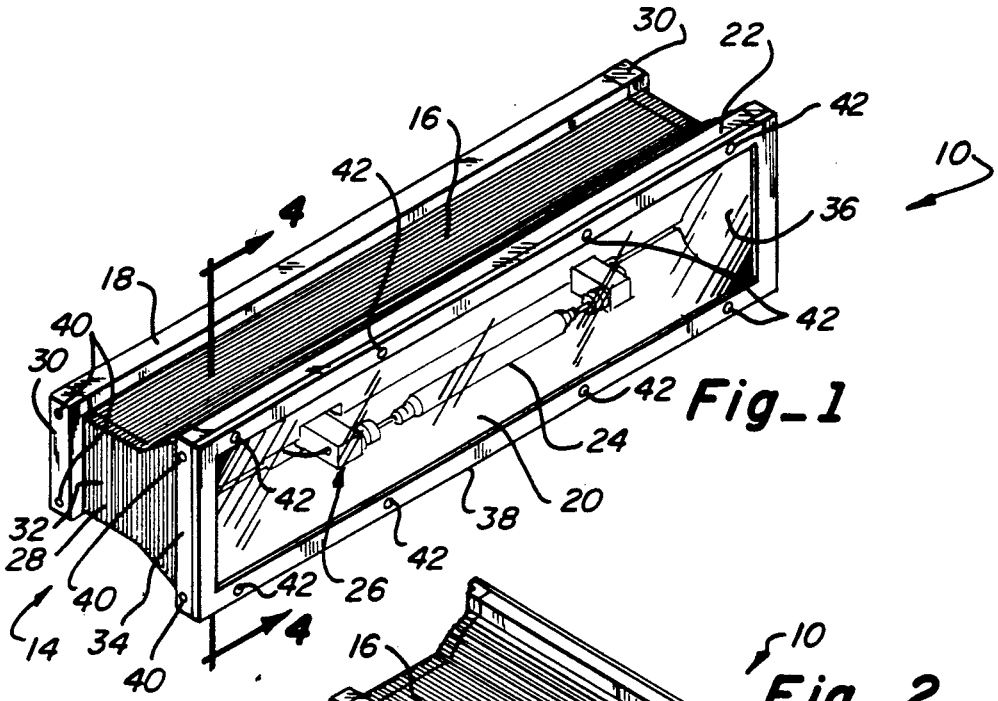
FIG. 1 is a perspective view of a light for a linear quartz halogen lamp bulb.
Figure 2:
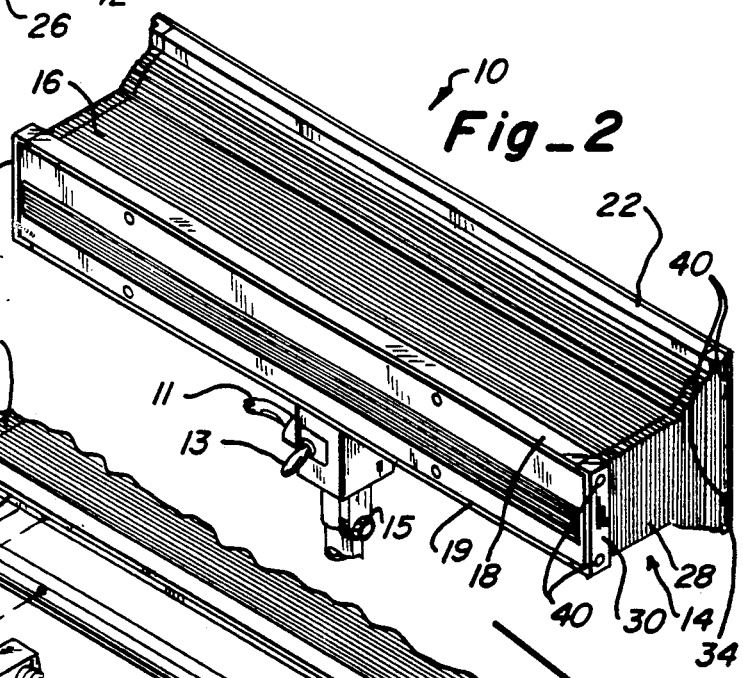
FIG. 2 is a rear perspective view similar to FIG. 1.
Figures 6, 7:
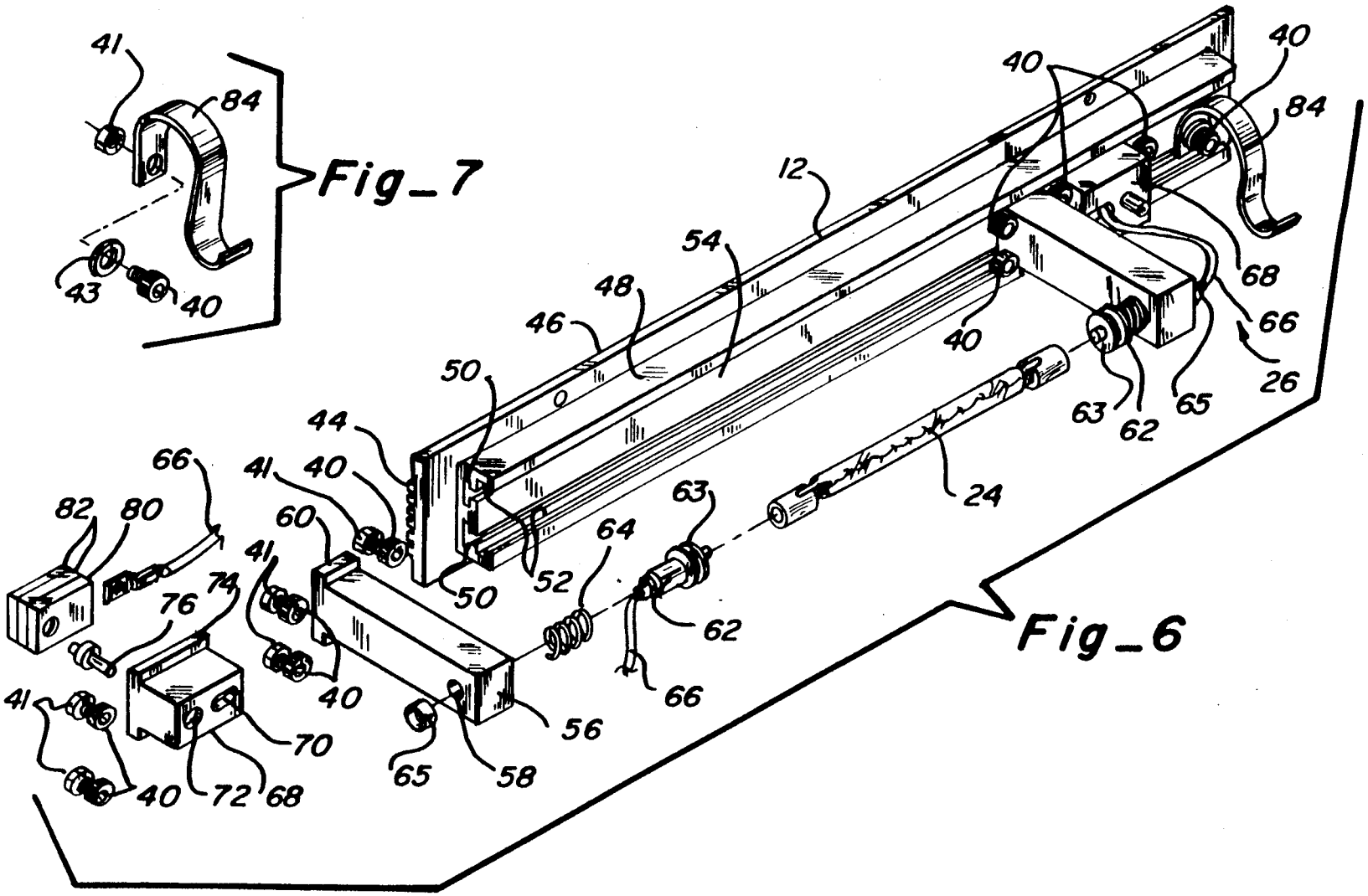
FIG. 6 is an exploded perspective view of the rear cover and bulb mount assembly.
FIG. 7 is an enlarged exploded perspective view of a ground spring mountable on the front cover.
Figure 8:
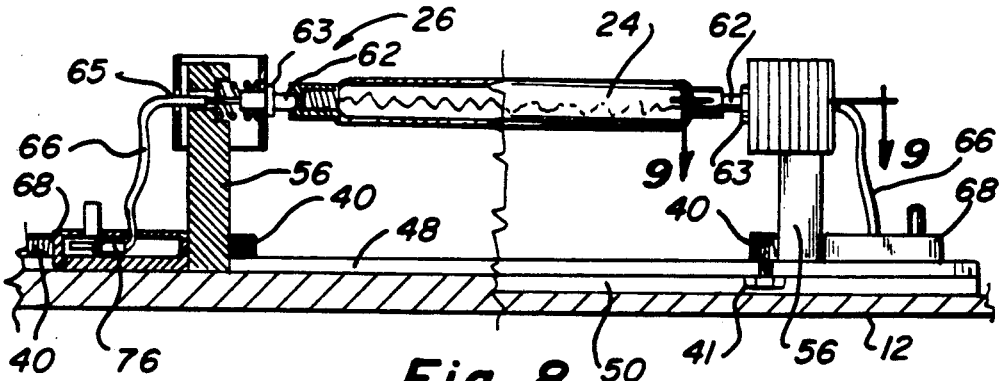
FIG. 8 is a partial sectional view of a side elevation of the assembled rear cover and bulb mount assembly.
Figure 10:
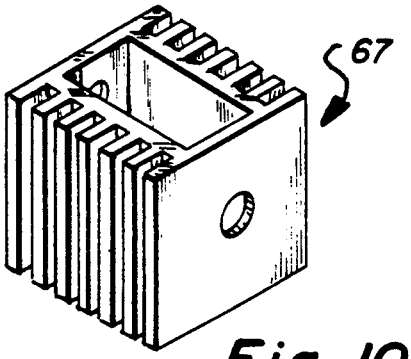
FIG. 10 is an enlarged perspective view of a heat sink of the bulb mount assembly.
Figure 9:
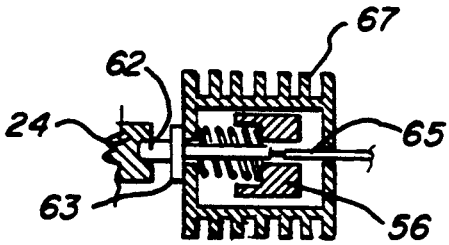
FIG. 9 is an enlarged sectional view taken in the plane of line 9—9 of FIG. 8.

Referring to FIG. 1, a light 10 for mounting a linear quartz halogen lamb bulb 24 is shown. The light 10 is connected to an alternating current power source (not shown) through cord 11 and is activated by a switch 13 (FIG. 2). A light mount 15 connects the light 10 in any suitable manner to a support (not shown). A bulb mount assembly 26 selectively receives the ends of the linear lamp bulb 24. (FIGS. 6, 8 and 9).

The bulb mount assembly 26 adjusts linearly along a longitudinal axis of the light, which axis is parallel to a longitudinal axis of the linear lamp bulb. Different sized linear lamp bulbs may be used with the single light 10.

Figure 3:
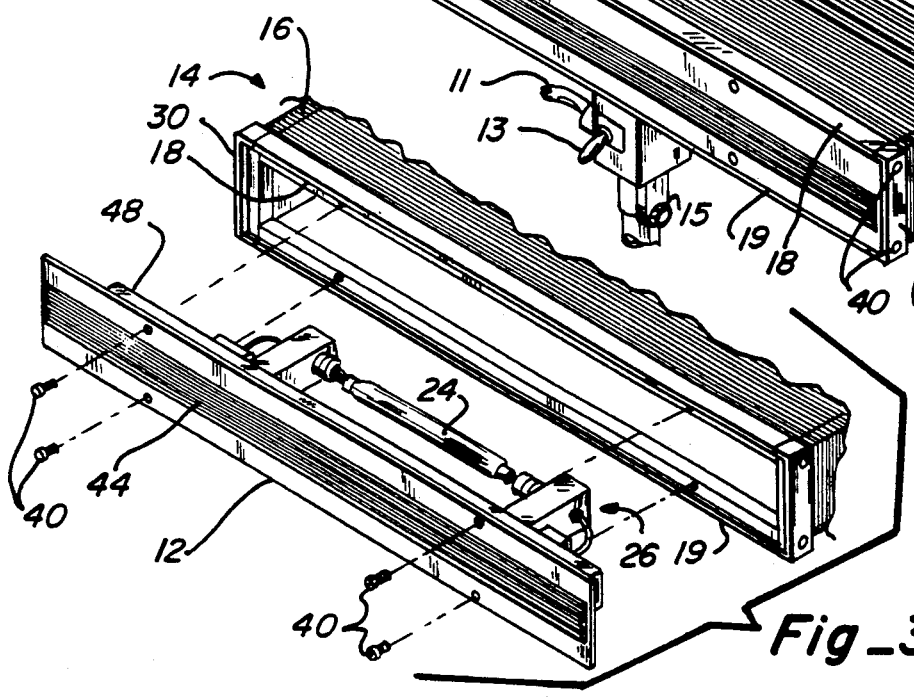
FIG. 3 is a fragmentary exploded perspective view of a front cover and a rear cover and bulb mount assembly for the linear lamp bulb.

The light 10 includes a first or rear cover 12 threadably secured to a second or front cover 14 by socket head cap screws 40 (FIG. 3). The front cover 14 is the main body of the light 10 and includes a main heat sink surface 16 incorporating longitudinally extending fins to assist in dissipating the heat generated by the linear lamp bulb 24. The main heat sink surface 16 is conventionally connected to the light mount 15 to permit the power cord 11 to enter the interior of the light 10 through the front cover 14. At the point of connection to the rear cover 12, the front cover includes a large flange 18 and a small flange 19 which, as the rear cover 12 is mated to the front cover 14, circumscribes the rear cover 12. Both the front and rear covers 14 and 12 are preferably formed of extruded aluminum.

Figure 4:
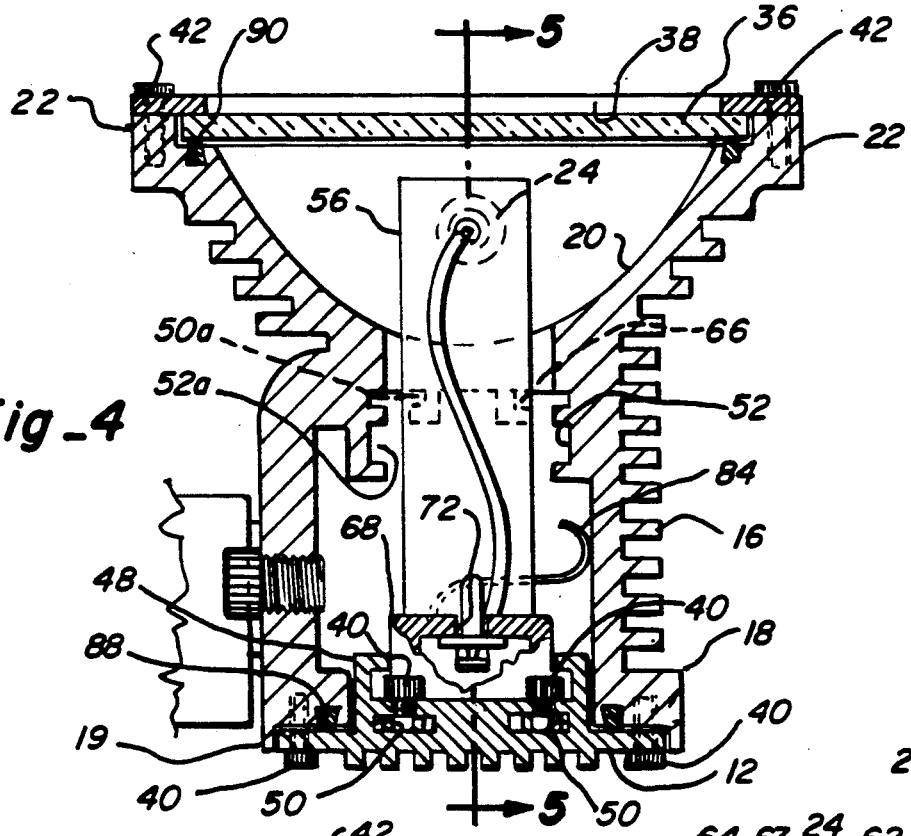
FIG. 4 is an enlarged sectional view taken in the plane of line 4—4 of FIG. 1.
Figure 11:
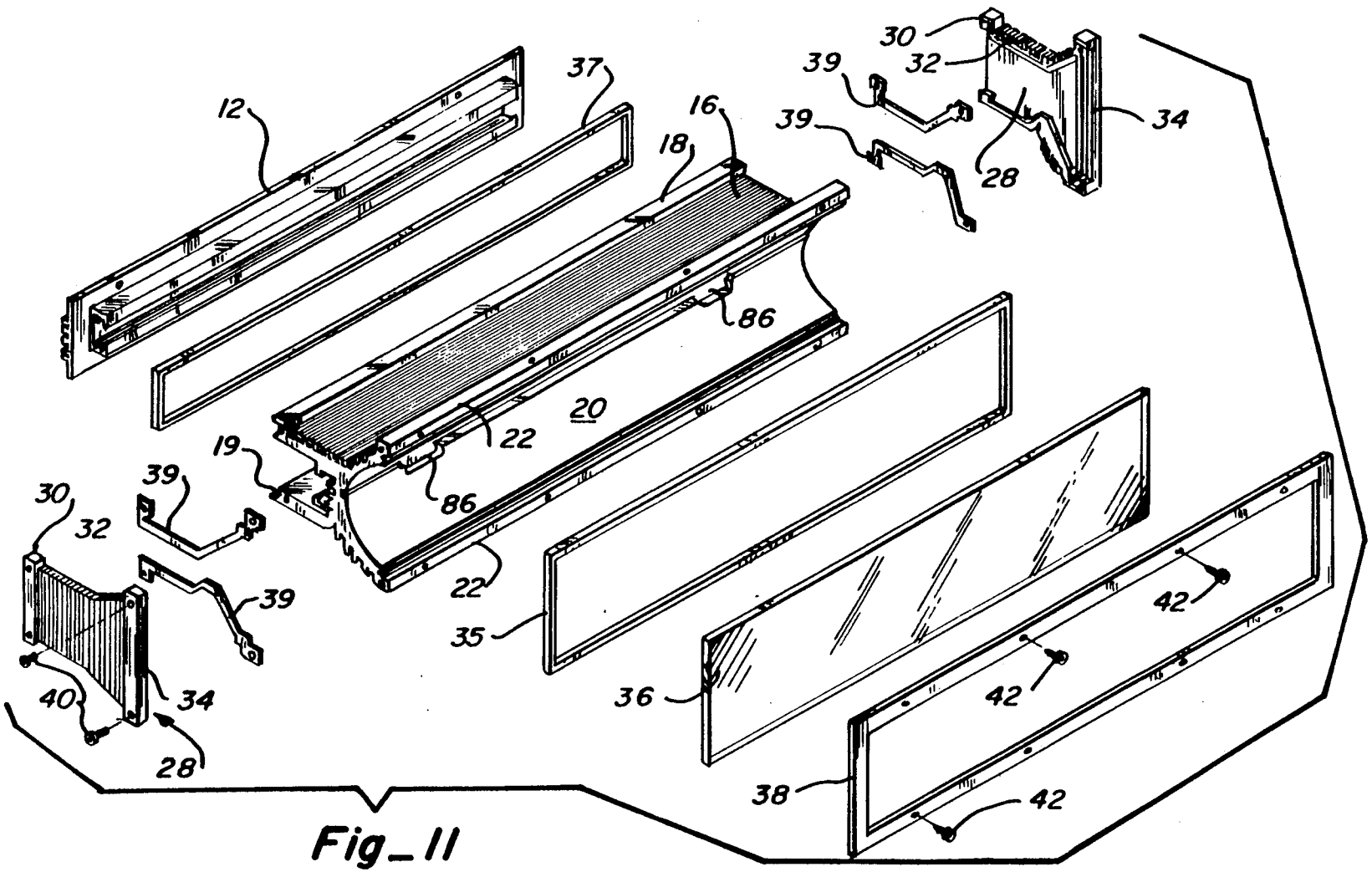
FIG. 11 is an exploded perspective view of the front cover, end plates, seals and front lens of the light.

A parabolic reflector surface 20 is formed during the extrusion process to manufacture the front cover 14. As best seen in FIG. 4, the entire front cover 14 is efficiently formed in a single extrusion process. Further milling and metalizing of the parabolic surface 20 are required to finish the manufacture of the front cover 14. A front flange 22 of the front cover circumscribes a front lens 36 and glass frame 38 (FIG. 11).

A pair of end plates 28, which are formed from aluminum castings, connect by additional cap head screws 40 to the rear and front covers 12 and 14. A rear flange 30 of each of the end plates 28 conforms with the large and small flanges 18 and 19, respectively, of the front cover 14 to circumscribe the rear cover 12 as it is mated to the front cover 12 and the end plates 28. The end plates 28 also have a heat sink surface 32 of extruded fins. A front flange 34 of the end plates 28 circumscribes the front lens 36, in conjunction with the front flange 22 of the front cover 14.

A housing of the light 10 is formed upon connection of the rear cover 12, front cover 14, end plates 28 and front lens 36. Button socket cap screws 42 are used to secure the glass frame 38 and the front lens 36 to the front cover 14 in a layered relationship, circumscribed by the front flange 22 and abutted against a front seal 35. A rear seal 37 fits within the flanges 18, 19 and 30 between the rear cover 12 and the front cover 14. The end plates 28 are sealed against the rear cover 12 and the front cover 14 by end seals 39.

The rear cover 12 (FIG. 6) also includes a heat sink surface 44 and is also extruded from aluminum. The rear cover 12 has a cover plate portion 46 which fits within the flanges 18, 19 and 30 of the front cover 14 and end plates 28 and is abutted against the rear seal 37.

A bulb mount extrusion 48 is integrally formed during the extrusion process for the rear cover 12. The bulb mount extrusion 48 includes longitudinally extending parallel grooves 50 to receive nuts 41 for selective threadable connection to the socket head cap screws 40. The socket head cap screws 40 slide along second longitudinally extending parallel grooves 52 formed in the bulb mount extrusion 48. Both the first and second grooves 50 and 52 are formed along a longitudinal axis parallel to the longitudinal axis of the light 10. The second grooves 52, in which the socket head cap screws 40 slide, also receive components to be mounted within the light 10, including a pair of lamp holder or post 56 and a pair of terminal housings 68. In a manner as to be discussed in more detail later, tightening of the screw heads 40 onto the nuts 41 defines means for positioning the lamp holders 56 and terminal housings 68 at preselected positions along the rear cover 12. The bulb mount extrusion 48 also includes a central land portion 54 on which the cap screw heads 40 slide until they reach their proper position for tightening and positioning of the lamp holders 56 and the terminal housings 68.

It will be appreciated that, at this point in the assembly of the light 10, the rear cover 12 acts as a mother board for the bulb mount assembly 26, all the components of the bulb mount assembly 26 being mounted to the rear cover 12. There are no direct connections to the power source. Power is available to the linear lamp bulb 24 upon connection of the rear cover 12 to the front cover 14, as will be described hereinafter.

The lamp holder 56 of the bulb mount assembly 26 is of rectangular block construction and includes integral laterally extending mounting legs 60 which are received along the second grooves 52 of the rear cover 12. A bulb contact bore 58 is formed through the lamp holder 56 to receive a metal bulb contact 62. The bulb contact 62 includes a pair of radially extending fins defining a heat sink 63 at the connection between the bulb contact 62 and a copper contact of the linear lamp bulb 24 (FIG. 9). The bulb contact 62 fits through an outer heat sink 67 and the bore 58 of the lamp holder 56. The heat sink 67 is excluded in some embodiments, see FIG. 1. Where the heat sink 67 is included, a bulb contact spring 64 is positioned intermediate the outer heat sink 67 and the lamp holder 56 biases the bulb contact 62 for axial movement along a longitudinal axis coaxial with the longitudinal axis of the linear lamp bulb 24. In embodiments without the heat sink 67, the spring 64 is held within the bore of the lamp holder 56 (not specifically shown), biasing the bulb contact 62 away from the lamp holder 56. Overcoming the bias in the bulb contact spring 64 permits the linear lamp bulb 24 to be inserted onto the bulb contact 62 at first one, and then a second, end of the linear lamp bulb 24.

Figure 5:
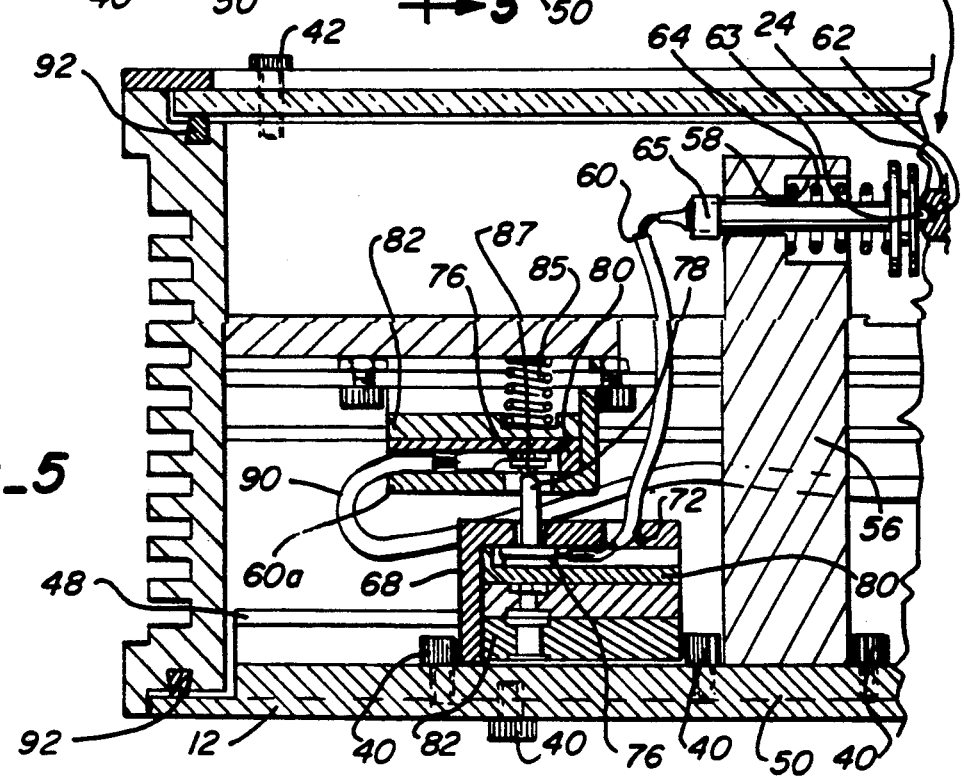
FIG. 5 is a fragmentary enlarged sectional view taken in the plane of line 5—5 of FIG. 4.

A bulb wire 66 is connected by a crimp collar 65 to an end of the bulb contact 62 opposite to the connection to one end of the linear lamp bulb 24. The bulb wire 66 is connected at its other end to a ring terminal 76 (FIGS. 5 and 6). The bulb wire 66 passes through a wire opening 70 in a terminal housing 68 associated with that end of the lamp bulb 24 and connects to a male terminal 78. The male terminal 78 projects through a terminal opening 72 in the terminal housing 68. There is a terminal housing 68 and terminal 78 for the other end of the linear lamp bulb 24, connected to another bulb wire 66.

In a manner identical to that described with respect to the lamp holder 56, the terminal housing 68 is slidable in the second grooves 52 of the rear cover 12 to a position established by the positioning means, the cap screw heads 40 and nuts 41. The terminal housing 68 is open to receive the bulb wires 66 and a ring terminal 76. These components are held in position by a contact carrier 80 which abuts against the terminal housing 68 and secures the ring terminal 76 and male terminal 78 in position. Two insulators or spacers 82 rest on the central land 54 of the bulb mount extrusion 48, holding the electrical contact terminal 78, ring terminal 76 and contact carrier 80 in position relative to the terminal housing 68.

Connection of the rear cover 12 and bulb mount assembly 26 to the front cover 14 will now be described. The front cover 14 includes complimentary first grooves 50A and second grooves 52A formed therein by an extrusion process. The grooves 50A and 52A are received by like nuts 41 and socket cap screws 40 to position a second pair of terminal housings 68 identical to the pair of terminal housings 68 slidably mounted within the rear cover 12. A hot wire 90 from the power cord 11 passes through the the front cover 14 and into the terminal housings 68A. The hot wire 90 connects to second ring terminals 76A and a pair of female terminals 87, one for each terminal housing 68A. The terminal pairs 78 and 87 are positioned so as to contact each other upon connection of the rear cover 12 to the front cover 14 (FIG. 5). Electrical power is available to the linear lamp bulb 24 once the rear cover 12 is connected to the front cover 14.

A ground spring 84 is connected in the second grooves 52A of the first cover 14. The ground spring 84 provides a make first-break last contact between the rear and front covers 12 and 14. This allows the ground to be made or broken before the terminals 78 and 87 make or break contact, preventing the likelihood of an electrical shock.

In connecting the rear cover 12 to the front cover 14, the lamp holders 56 pass through openings formed in the parabolic reflecting surface 20. At that point, the rear cover 12 is connected to the front cover 14 by the screws 40. The linear lamp bulb 26 is then connected to the bulb contacts 62 by biasing one of the contacts 62 against the spring 64 as previously described.

Figure 12:
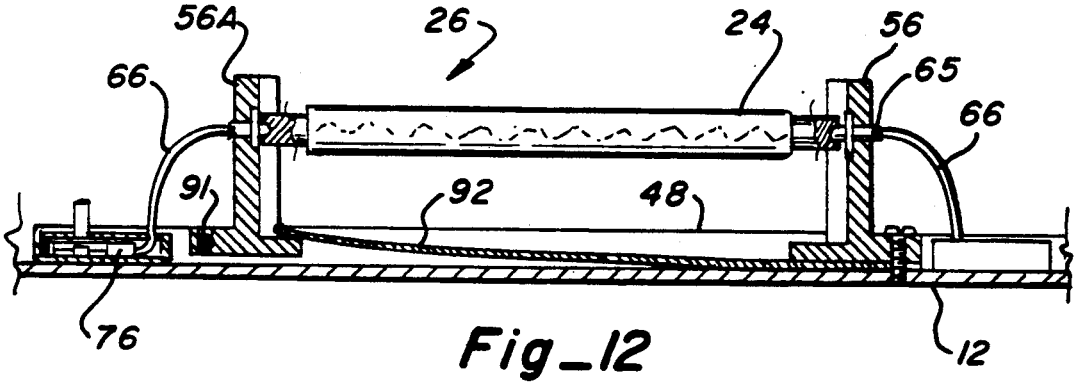
FIGS. 12 and 13 are side elevational views of an alternative bulb mount assembly of the invention.
Figure 13:
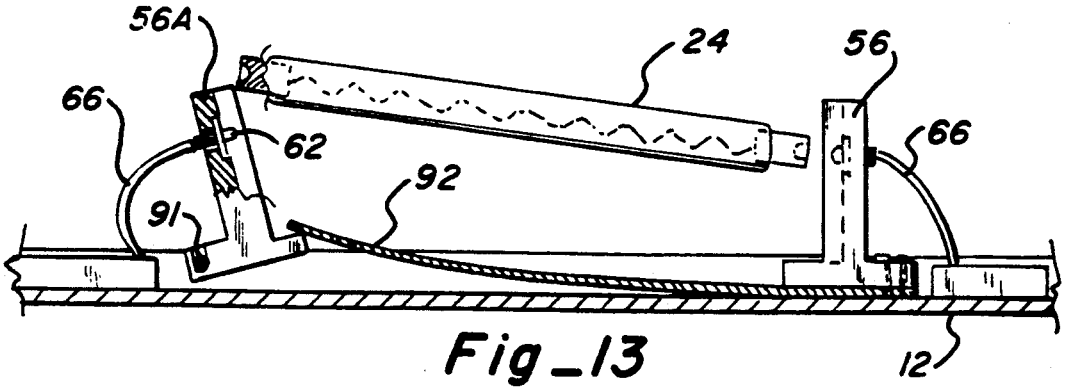

In the alternative embodiment shown in FIGS. 12 and 13, like parts having like numbers, spring biasing of the lamp holders 56 along a longitudinal axis is not incorporated into the bulb mount assembly 26. Rather, one lamp holder 56A is pivoted relative to the rear cover 2 about pivotal connection 91. A leaf spring 92 biases the pivotal lamp holder 56A against the rear cover 12. Pivoting the lamp holder 56A relative to the rear cover 12 allows the linear lamp bulb 24 to be inserted intermediate the two lamp holders 56A and 56 for mounting.

Although the present invention has been described with a certain degree of particularity, it is understood that the present disclosure has been made by way of example, and changes in detail or structure may be made without departing from the spirit of the invention, as defined in the appended claims.

What is claimed is:

1. A light including a high intensity linear lamp bulb comprising in combination:

an electrical power source;

a first cover having longitudinally extending grooves for slidably receiving positioning means selectively connected to the first cover;

a second cover connected to said first cover having an integrally formed longitudinal reflector, a lens mounted to said second cover; and means for releasably connecting each of two ends of said lamp bulb slidable along said grooves, selectively positioned by said positioning means and conductively connected to said power source.

2. The invention as defined in claim 1 wherein said means for releasably connecting said lamp bulb further includes:

a lamp post slidable along said grooves and selectively positioned relative to said first cover by said positioning means; and a bulb contact selectively connected to said lamp bulb, conductively connected to said power source and biased for movement relative to said lamp post along an axis corresponding to a longitudinal axis of the lamp bulb.

3. The invention is defined in claim 2 further including a terminal housing slidable along said grooves and selectively positioned relative to said first cover by said positioning means, said terminal housing having a contact carrier conductively connected to said bulb contact and to a terminal in electrical contact with said power source upon connection of said first cover to said second cover.

4. The invention as defined in claim 3 further including a second terminal housing slidable along complimentary grooves formed in said second cover and selectively positioned relative to said second cover by second positioning means associated with said second cover, said second terminal housing having a second contact carrier conductively connected to said power source and to a second terminal, whereby connecting said first and second covers places said first and second terminals into contact to selectively energize said lamp bulb.

5. The invention as defined in claim 3 wherein said terminal housing receives a conductive wire through one opening and said terminal projects through a second opening in said terminal housing.

6. The invention as defined in claim 3 wherein said terminal housing is hollow and a plurality of spacers support said contact carrier at a preselected distance from said first cover and place said carrier in contact with said terminal housing.

7. The invention as defined in claim 1 further including end plate covers connected to said first and second covers.

8. The invention as defined in claim 7 wherein a front lens is held in a sealed position by a front seal and a frame connected to said front cover, said end plate covers having end seals secured intermediate the connection between said front cover and said end plate covers and said rear cover having a rear seal secured intermediate to the connection between rear cover and said front and end plate covers.

9. The invention as defined in claim 2 wherein said bulb contact further includes means for radiating heat away from said connection to said said lamp bulb.

10. The invention as defined in claim 9 further including second means for radiating heat away from said connection, said second means conformably fitting over said lamp post at the bult contact connection to the lamp bulb.

11. The invention as defined in claim 1 wherein said first and second covers are formed by a process comprised of the step of extruding a block of aluminum.

12. The invention as defined in claim 1 wherein said means for releasably connecting each of two ends of said lamp bulb further includes means for accommodating linear expansion due to heat generated by the lamp bulb.

13. The invention as defined in claim 1 wherein said first and second covers each further include fins formed on outer surfaces thereof for radiating heat away from said light.

14. A light including a high intensity linear lamp bulb comprising in combination:

an electrical power source;

a housing including a first and second cover, one of said first or second covers including longitudinally extending grooves formed therein for selectively receiving a bulb mount assembly, said bulb mount assembly including separate bulb contacts slideable along said grooves, one of said first or second cover having electrical terminals to which said power source is connected, whereby upon connection of said first cover to said second cover said bulb contacts pass through a reflector surface formed in said second cover and electrical connection is established between said power source and said bulb contacts.

15. The invention as defined in claim 14 wherein said second cover includes grooves formed longitudinally therein for selective positioning of the terminals electrically connected to said power source.

16. The invention as defined in claim 15 wherein said first and second covers each includes pairs of electrical terminals mounted in a terminal housing slideable in the respective grooves formed in said first and second covers, said terminal housing positioned by positioning means for fixing the position of said terminal housing relative to said first and second covers.

17. The invention as defined in claim 14 wherein said bulb mount assembly further includes:

means for radiating away from the connection between said bulb contact and said linear lamp bulb; and means for accommodating linear expansion of said lamp bulb.

18. The invention as defined in claim 14, wherein said bulb mount assembly includes a lamp post slideable along grooves formed in said housing and selectively positioned by means for positioning said lamp post.

19. The invention as defined in claim 145, wherein said housing includes radiating fins formed on an outer surface thereof for radiating heat generated by said linear lamp bulb away from said light.

20. A light including a high intensity linear lamp bulb comprising in combination:

an electrical power source;

a housing having mounted thereon a bulb mount assembly for connection to said linear lamp bulb, said bulb mount assembly including means for radiating heat away from the connection between said bulb mount assembly and said linear lamp bulb, said means for radiating heat including a bulb contact spring biasly connected to a lamp post connected to said housing and radiating fins mounted near the connection between said linear bulb and said bulb contact.

21. The invention as defined in claim 20 wherein said means for radiating heat away from said linear lamp bulb connection to said bulb mount assembly further includes a second heat sink fitting about said spring bias connection between said lamp bulb and said lamp post.

* * * * *